United States Patent [19]

Tucker

[11] 4,171,595

[45] Oct. 23, 1979

[54] INFLATABLE HUNTING BLIND SHELTERS

[76] Inventor: Gordon W. Tucker, Rte. 1, Box 31, Pollok, Tex. 75969

[21] Appl. No.: 872,569

[22] Filed: Jan. 26, 1978

[51] Int. Cl.[2] ..... E04B 1/345; A47K 3/23; A01M 31/02

[52] U.S. Cl. ..... 52/2; 4/145; 43/1

[58] Field of Search ..... 52/2; 43/1; 135/14 R, 135/14 D, 14 V; 4/145

[56] References Cited

U.S. PATENT DOCUMENTS

| | | | |
|---|---|---|---|
| 1,964,818 | 7/1934 | Hood | 52/2 |
| 2,297,150 | 9/1942 | Hunter | 52/2 |
| 2,646,057 | 7/1953 | Blanchard | 135/14 D |
| 2,955,606 | 10/1960 | Walker | 52/2 |
| 2,992,503 | 7/1961 | Webb | 43/1 |
| 3,011,824 | 12/1961 | Vassallo et al. | 135/14 V X |
| 3,052,054 | 9/1962 | Littleton et al. | 52/2 X |
| 3,483,571 | 12/1969 | Cox, Jr. | 4/145 |
| 3,540,170 | 11/1970 | Flowers | 43/1 X |
| 3,936,969 | 2/1976 | Richard | 43/1 |
| 4,068,326 | 1/1978 | Deschler | 4/145 X |

FOREIGN PATENT DOCUMENTS

| | | | |
|---|---|---|---|
| 2036274 | 1/1972 | Fed. Rep. of Germany | 4/145 |
| 791695 | 3/1958 | United Kingdom | 52/2 |

*Primary Examiner*—Alfred C. Perham
*Attorney, Agent, or Firm*—Neal J. Mosely

[57] ABSTRACT

An outdoor hunting blind shelter which is completely portable, all weather, and compact is an inflatable single unit hunting blind and a camper's restroom facility combined, furnishing features consisting of walls and roof which are supported by hollow, tube-type ribs forming a framework all of which are made of vinyl plastic. The hollow, vinyl plastic ribs are inflated with air through an air valve located in the foundation rib. The walls and roof are of thin plastic vinyl material joined to the ribs, and they feature an opening for entry and departure in one wall of the shelter. Windows for viewing and firing firearms are provided in the other walls. Support tie-off loops are located at each corner top and bottom of the shelter for extra support if needed. Restroom facilities include both shower and tub combinations.

10 Claims, 7 Drawing Figures

INFLATABLE HUNTING BLIND SHELTERS

SUMMARY

This invention relates to outdoor, portable hunting blind shelters.

For ages it has been a common practice to construct or erect hunting blind shelters designed to furnish protection from the weather, undetection from game animals, and comfort while outdoors. The most common hunting blind shelter designed to offer these services consists of a framework which supports walls and roof, all of which are cut, sawed, nailed, bolted, weilded, or tied to said framework. Windows and gun holes, cut or sawed in the walls, provide a means for viewing and firing firearms from within the hunting blind. A door, also cut in one wall, provides a means of entry and departure from said shelter. The most common disadvantages related to this kind of structure are cost of materials, storage, mobility, convenience to relocate, and complex assembly.

The all-weather, portable hunting blind shelter disclosed herein is provided with objects and advantages that are new, improved, and useful in relation to what is old. This is accomplished by an all-vinyl plastic framework that becomes erected and held in position by air which is trapped and held inside of hollow, tube-type ribs. The framework becomes erected when air is forced through a novel three-way air valve into the framework.

The novel valve includes three valves in one, which enables frame structure to be inflated by human lung power, by needle valve pump, or by means of a novel air transfer hose which allows air to be transferred from an ordinary spare tire valve stem on a spare tire to the valve core in the three-way valve. The air pressure within the ribs of the framework allows frame to support the thin vinyl plastic walls and roof, which are sealed and attached to the ribs permanently, making said shelter a one-unit structure.

Due to the light weight of this shelter, convenient stake loops on the bottom of the structure are provided at each corner for added stability in case of strong winds. Novel clover leaf tie-off loops are provided at corners of top of structure to allow tie off if desired.

Available in the walls are novel gun hole and window combination openings which allow maximum view and shooting convenience to surrounding outside areas, while at the same time allowing only minimum air draft to enter structure. Windows also have novel weather flaps attached to them for protection of user from outside weather and for privacy. A slit opening is provided in one wall for easy access into the blind, with a long privacy weather flap hanging downward over slit opening.

The all-weather, portable hunting blind shelter shown herein is also a novel outdoors restroom facility. A novel plastic vinyl, inflatable shower pan-tub stored against and attached to the inside wall of shelter becomes operational when unfolded from stored position and inflated with air through same type three-way air valve as stated earlier. Water is furnished for the shower facility from outside the shelter by means of direct hydrant water which flows through a plastic hose into the shelter through a hose inlet hole in the wall of the shelter. The water is then released from a shower nozzle which has a "push, to flow" and "release, to stop" mechanism. If hydrant water is not available, water would be furnished by means of attaching the outside end of the shower hose to a hose connection on a water bucket hanging from or sitting on an object outside of blind at an elevation higher than the hose entry inlet in the wall. The waste water in the shower pan-tub is discharged out of the pan-tub via a plastic drain located in the bottom rear of the pan-tub.

If a tub bath is desired over a shower bath, tub facility becomes available by inserting a drain plug into the shower pan-tub drain, thus allowing the pan-tub to be filled with bath water. Waste water is disposed of by the same drain opening.

Hunting blind shelter also becomes a "Johnny-on-the-spot" when any type of portable waste container is used inside of it.

The details, as well as other objects and advantages, of this invention are set forth in the remainder of the specifications and are shown in the drawings in which.

Figure 1:
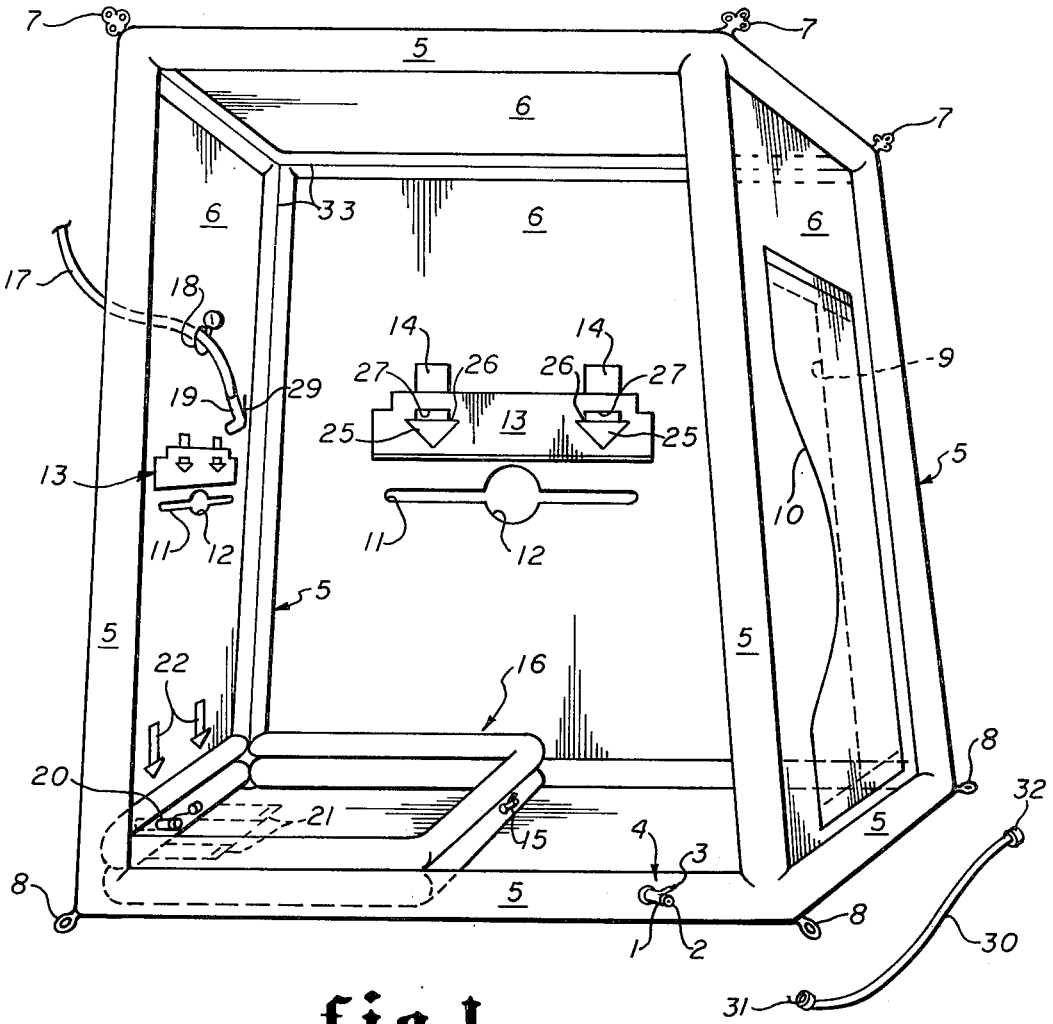
FIG. 1 is a sectional elevational view of the hunting blind structure showing the entire structure.
Figure 2:
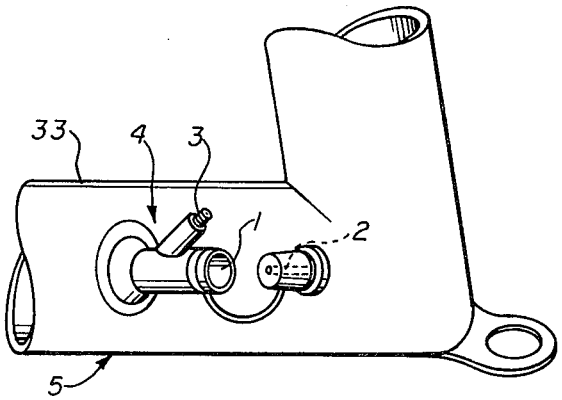
FIG. 2 is an enlarged view of the three-way valve showing the configuration of the three parts of the valve.

Referring first to FIG. 1, the portable all-weather inflatable hunting blind shelter has a framework 5 made of vinyl plastic material seamed 33 together to form hollow, tube-type ribs 5 which are inflated and erected by means of air pressure trapped and held inside the hollow, tube-type ribs 5. The air enters the ribs 5 through a three-way air valve 4 consisting of three separate air valves, 1, 2, and 3 consolidated into one air valve, which is best shown in FIG. 2, where valve 1 is an open end air valve used to inflate ribs 5 by human lung air. Valve 2 is a needle air valve where ribs 5 can be inflated by a needle valve pump. Valve 3 is a valve core valve whereby ribs 5 can be inflated by transferring air from a spare tire to the shelter, thereby providing an easy, convenient way to inflate the hunting blind shelter for elderly people who may not have the lung power to use valve 1. The air pressure in the framework 5 causes erection of the plastic vinyl material walls and roof 6 thus forming a one-unit structure.

Figure 4:
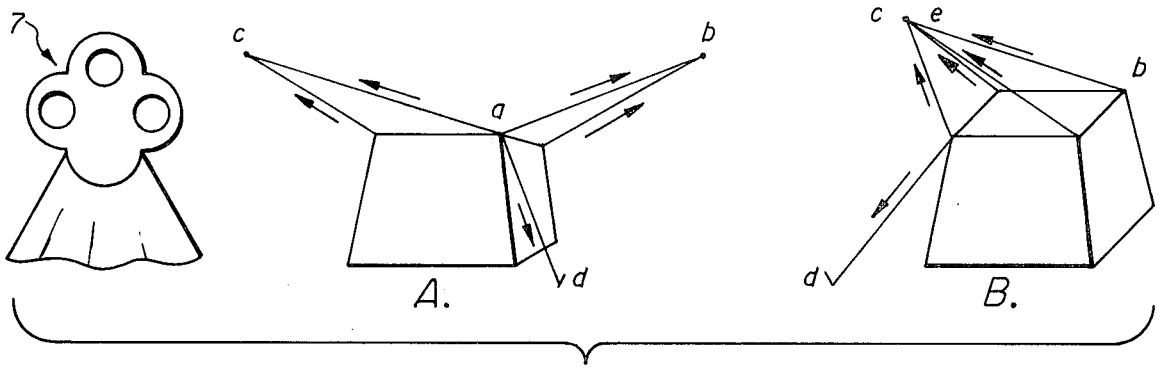
FIG. 4 is an enlarged view of the clover leaf tie off showing various tie off angles possible.

Flexible plastic clover leaf tie offs 7 are located at the top corners which provide means of added stability in strong winds. The clover leaf tie offs 7 can be used to tie off corners at various angles from one or more central location points, as best shown in FIG. 4, (In view A, corner (a) is held in support by points (b) and (c). In view B, corners (a) and (b) are supported by central point (c).) These various ways of tie off are made possible by the clover leaf tie off 7, FIG. 4 showing three tie off holes in one loop that can be twisted in positions where the various tie offs such as A and B can be accomplished.

Referring back to FIG. 1, a long vertical slit opening 9 for easy entry and departure of the shelter is covered by a vinyl plastic flap 10 affixed to the outside wall above the slit opening 9. The flap 10 is loose and free on each side and bottom so flap 10 can be raised out of way when entering slit 9. The flap 10 hangs in a downward direction covering slit 9 entrance for privacy and weather protection.

Figure 3:
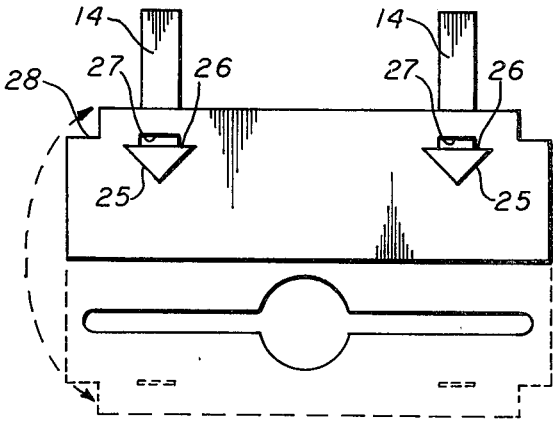
FIG. 3 is an enlarged view of the viewing window along with associated counter parts.

Narrow, elongated windows 11 in the walls 6 of the structure, which is best shown in FIG. 3 provide maximum viewing to outside areas and allows minimum outside air draft in shelter. A round, somewhat larger gun hole opening 12 centered in the center of the windows 11 provides adequate access for fire-arms with open end or scope mounted sight to be used through gun hole 12 at a variety of desired horizontal and vertical angles. The windows 11 and 12 are supplied with weather flaps 13, best shown in FIG. 3, hanging in a downward direction, having arrow head designed tips 25 on the ends which insert through slots 27 cut in flap 13, causing edges 26 of the arrow tips 25 to fit securely in the slots 27 thus locking arrow head tips 25 in slots 27 holding flap in a secured and sloted position above the windows 11 and 12.

Figure 5:
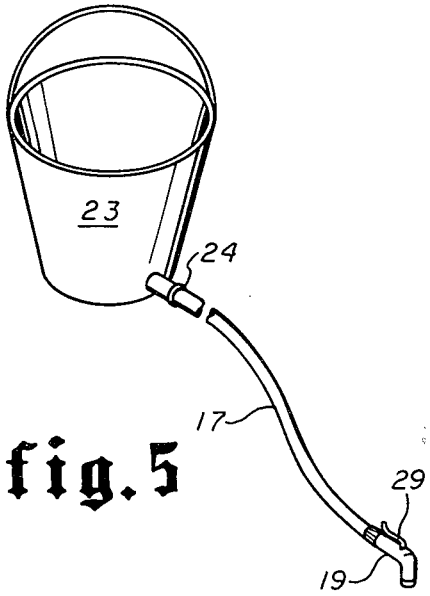
FIG. 5 is an enlarged view of the shower nozzle and shower hose with a connection to a water bucket.
Figure 6:
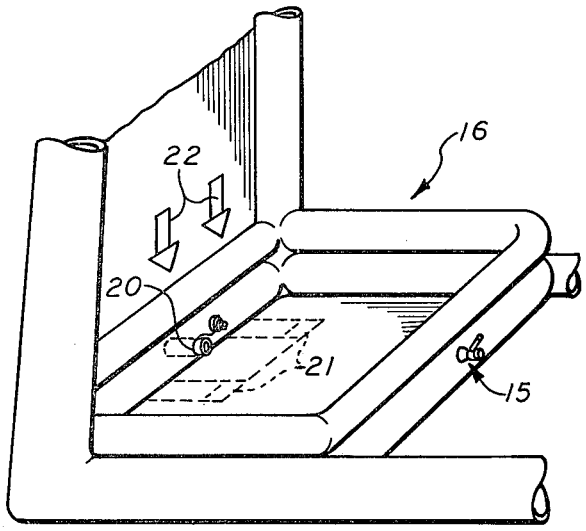
FIG. 6 is an enlarged view of the shower and/or tub facilities and counter parts.

Referring still to FIG. 1, an inflatable vinyl plastic shower pan-tub 16 is available with its inside walls and bottom attached to and part of the back wall inside of shelter. The pan-tub 16 is kept stored in a rolled up position and held secure by two straps 22 hanging in a downward position around the rolled up pan-tub 16 and inserted in straps 21 coming from beneath pan-tub 16 in which the arrow tip points of straps 22 are inserted through slots of straps 21 locking and holding pan-tub 16 in the stored position. Shower pan-tub 16 is operational when released and unrolled from its stored position and inflated with air by means of a three-way air valve 15. Shower water is provided by means of direct hydrant water furnished through a plastic water hose 17 through a hose inlet hole 18 to shower nozzle 19 located inside of hunting blind structure. In the event that hydrant water is not available, shower water would be furnished by a water bucket 23, as best shown in FIG. 5 hanging or sitting on an object outside of the shelter at an elevation higher than hose inlet 18 in FIG. 1 to shower nozzle 19 located inside of hunting blind shelter regulating the water from bucket 23 by means of a "push, to flow" and "release, to stop" flow valve 29 in shower nozzle 19. The water is furnished from bucket 23 through hose 17 through nozzle 19 by gravitational flow. The shower pan-tub 16, better viewed in FIG. 6 becomes a bath tub facility by inserting drain plug of drain 20 into drain, thereby trapping water in the pan-tub 16. Waste water is removed from the shower pan-tub 16 via a plastic drain 20 located in bottom rear of the shower pan-tub 16 to outside of the hunting blind shelter.

Figure 7:
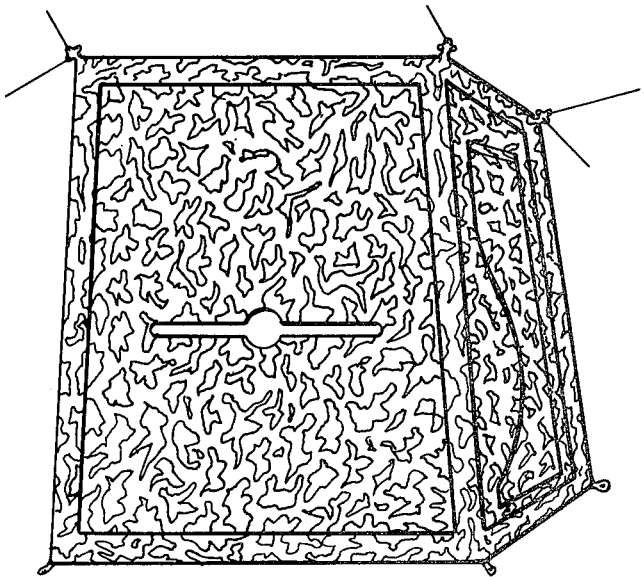
FIG. 7 is a view of the hunting blind structure as it would appear to the hunter.

FIG. 7, shows a view of the portable, all-weather hunting blind shelter as it would appear when inflated and erected by the hunter. For use as a hunting blind shelter, it provides protection from the weather; and by being camouflaged in design and color, it provides concealment from game animals.

Hunting blind shelter, FIG. 7, also becomes a "Johnny-on-the-spot" when any type of portable waste container is used inside of it.

It will be appreciated, of course, that the advantages of providing a hunting blind shelter which provides the necessary qualities desired and can also be a restroom facility may be utilized individually.

I claim:

1. An inflatable shelter for game hunters comprising,
- a plurality of hollow inflatable tubes interconnected to be fillable with air from a single inlet and spaced to form a supporting framework for a roof and sidewalls when inflated,
- a plurality of flexible weather-proof wall members secured to and supported by said tubes to form the roof and side walls of said shelter when inflated,
- one of said side walls having a slit opening therein for entry to the inflated shelter,
- one of said side walls having a gun hole therein comprising a circular center opening, narrow slot-like openings extending to either side thereof, and
- a valved opening to one of said tubes for introduction of compressed air thereto for inflating said shelter.

2. An inflatable shelter according to claim 1 in which said tubes and said wall members are of thin flexible thermoplastic material.

3. An inflatable shelter according to claim 2 in which said valved opening is a three-way valve providing for inflation by mouth, by needle valve, or by valve core.

4. An inflatable shelter according to claim 2 in which a flexible cover flap is secured to one of said side walls to cover at least one of the side wall openings.

5. An inflatable shelter according to claim 4 in which said flap covers said gun hole and said gun hole side wall includes straps for securing said gun hole flap in an open position above said gun hole.

6. An inflatable shelter according to claim 1 in which said tubes include tying grommets secured thereon at the corners of said framework for tying the same to external places of support.

7. An inflatable shelter according to claim 1 including a plurality of hollow inflatable tubes secured to and opening into one of said first named tubes and cooperating therewith to from a horizontal enclosure, a wall member secured to said last named tubes and cooperable therewith to form a shallow tub for containing water, and said last named tubes being inflatable with the tubes forming the framework of said shelter.

8. An inflatable shelter according to claim 3 in which a flexible cover flap is secured to one of said sidewalls to cover at least one of the side wall openings.

9. An inflatable shelter according to claim 8 in which said tubes include tying grommets secured thereon at the corners of said frame work for tying the same to external places of support.

10. An inflatable shelter according to claim 9 including a plurality of hollow inflatable tubes secured to and opening into one of said first-named tubes and cooperating therewith to torm a horizontal enclosure, a wall member secured to said last named tubes and cooperable therewith to form a shallow tub for containing water, and said last named tubes being inflatable with the tubes forming the framework of said shelter.

* * * * *